US009304457B2

(12) United States Patent
Takeuchi et al.

(10) Patent No.: US 9,304,457 B2
(45) Date of Patent: Apr. 5, 2016

(54) FIXING DEVICE PROVIDED WITH MEMBER FOR COVERING TERMINAL OF HEATER

(71) Applicant: Brother Kogyo Kabushiki Kaisha, Nagoya-shi, Aichi-ken (JP)

(72) Inventors: Kenji Takeuchi, Nagoya (JP); Kotaro Haruta, Yokkaichi (JP); Takuji Matsuno, Ichinomiya (JP); Yoshihiro Miyauchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/484,319

(22) Filed: Sep. 12, 2014

(65) Prior Publication Data

US 2015/0093161 A1 Apr. 2, 2015

(30) Foreign Application Priority Data

Sep. 30, 2013 (JP) ..... 2013-203695
Sep. 30, 2013 (JP) ..... 2013-203716
Sep. 30, 2013 (JP) ..... 2013-203727

(51) Int. Cl.
*G03G 15/20* (2006.01)
*G03G 15/16* (2006.01)
*G03G 15/08* (2006.01)

(52) U.S. Cl.
CPC ..... *G03G 15/2053* (2013.01)

(58) Field of Classification Search
CPC ..... G03G 15/2053
USPC ..... 399/328, 122, 90, 330, 335
See application file for complete search history.

(56) References Cited

U.S. PATENT DOCUMENTS 5,974,285 A * 10/1999 Tomatsu ..... 399/88
6,275,669 B1 * 8/2001 Hasegawa ..... 399/90
8,995,868 B2 * 3/2015 Moriya et al. ..... 399/90
2007/0242989 A1 * 10/2007 Miyake ..... 399/328

FOREIGN PATENT DOCUMENTS

JP 2009-180839 A 8/2009
JP 2009295462 A * 12/2009

* cited by examiner

*Primary Examiner* — Billy Lactaoen
(74) *Attorney, Agent, or Firm* — Banner & Witcoff, Ltd.

(57) ABSTRACT

A fixing device includes a tubular body extending in a first direction, a heater disposed in an internal space of the tubular body, a frame supporting the tubular body and a plate-like member provided on the frame. The tubular body has an open end in the first direction. The heater includes a hollow tube extending in the first direction, a heat generating element disposed in a hollow space of the tube, a terminal fixed to the frame, and a pin connecting the heat generating element and the terminal. The frame has a first surface positioned to oppose the open end of the tubular body in the first direction. The plate-like member is positioned between the open end and the first surface in the first direction, the plate-like member being formed with a pin opening for permitting the pin to penetrate therethrough.

15 Claims, 13 Drawing Sheets

FIXING DEVICE PROVIDED WITH MEMBER FOR COVERING TERMINAL OF HEATER

CROSS REFERENCE TO RELATED APPLICATION

This application claims priorities from Japanese Patent Application Nos. 2013-203695 filed Sep. 30, 2013, 2013-203716 filed Sep. 30, 2013 and 2013-203727 filed Sep. 30, 2013. The entire contents of the priority applications are incorporated herein by reference.

TECHNICAL FIELD

The present invention relates to a fixing device having a heater disposed in an internal space of a tubular body.

BACKGROUND

There is conventionally known a fixing device provided with a heater disposed in an internal space of a tubular member and a frame supporting the tubular body (see JP2009-180839, for example). In this fixing device disclosed in this reference, the tubular body has an end opening (an opening formed in an end portion of the tubular body) such that the heater is inserted into the internal space of the tubular body through the end opening. The tubular body is thus heated from inside by heat of the heater.

The heater is connected to a terminal fixed to the frame. Specifically, the heater is connected to a pin connected to the terminal. The heater is configured to generate heat upon receipt of power from the terminal via the pin.

SUMMARY

In the above-described configuration, radiant heat from the heater is transmitted to outside of the tubular body through the end opening. Further, since the heater is connected to the terminal, heat of the heater is easily transmitted to the terminal. Thus, a portion of the frame near the end opening as well as a portion of the frame to which the terminal is fixed may tend to be heated too high. When the temperature of the frame becomes too high, occurrence of UFPs (Ultra Fine Particles) is conceivable.

Further, preferably, the pin is insulated from its environmental components, considering a possibility that foreign matters such as metal pieces may be adhered to the pin.

In view of the foregoing, it is an object of the present invention to provide a fixing device capable of: preventing excessive increase in temperature of a portion of the frame near the end opening of the tubular body, and thus suppressing occurrence of UFPs.

It is another object of the present invention to provide a fixing device capable of preventing excessive increase in temperature of a portion of the frame to which the terminal is fixed, and thus further suppressing occurrence of UFPs.

It is still another object of the present invention to provide a fixing device capable of maintaining insulation property of the pin connected to the heater.

In order to attain the above and other objects, there is provided a fixing device that may include a tubular body, a heater, a frame and a plate-like member. The tubular body defines an internal space therein and extends in a first direction and has an open end in the first direction. The heater is disposed in the internal space and extends in the first direction. The heater includes: a hollow tube extending in the first direction and defining a hollow space therein; a heat generating element disposed in the hollow space; a terminal; and a pin connecting the heat generating element and the terminal. The frame is configured to support the tubular body, the frame having a first surface positioned to oppose the open end in the first direction, the terminal being fixed to the frame. The plate-like member is configured to be provided on the frame and is positioned between the open end and the first surface in the first direction, the plate-like member being formed with a pin opening for permitting the pin to penetrate therethrough.

According to another aspect of the present invention, there is provided a fixing device that may include: a tubular body defining an internal space therein; a heater disposed in the internal space; a terminal connected to the heater; a frame configured to support the tubular body and having an attachment surface to which the terminal is fixed; and an insulating member provided between the terminal and the attachment surface.

According to still another aspect of the present invention, there is provided a fixing device that may include a tubular body, a heater, a frame and an insulating member. The tubular body extends in a first direction and defines an internal space therein. The heater is disposed in the internal space and extends in the first direction. The heater includes: a hollow tube extending in the first direction and defining a hollow space therein, the tube having one end portion in the first direction; a heat generating element disposed in the hollow space; a terminal; and a pin provided at the one end portion of the tube and connecting the heat generating element and the terminal. The frame is configured to support the tubular body, the terminal being fixed to the frame. The insulating member has a fixing portion fixed to the frame and a covering portion extending from the fixing portion toward the pin to cover the pin.

DETAILED DESCRIPTION

First, a general configuration of a color printer 1 provided with a fixing device 100 according to an embodiment of the present invention will be described with reference to FIG. 1.

Throughout the specification, the terms "above", "below", "right", "left", "front", "rear" and the like will be used assuming that the color printer 1 is disposed in an orientation in which it is intended to be used. More specifically, in FIG. 1, a right side, a left side, a near side and a far side will be referred to as a front side, a rear side, a left side and a right side of the color printer 1, respectively. A vertical direction in FIG. 1 will be referred to as a vertical (up-down) direction of the color printer 1.

<General Structure of the Color Printer>

Figure 1:
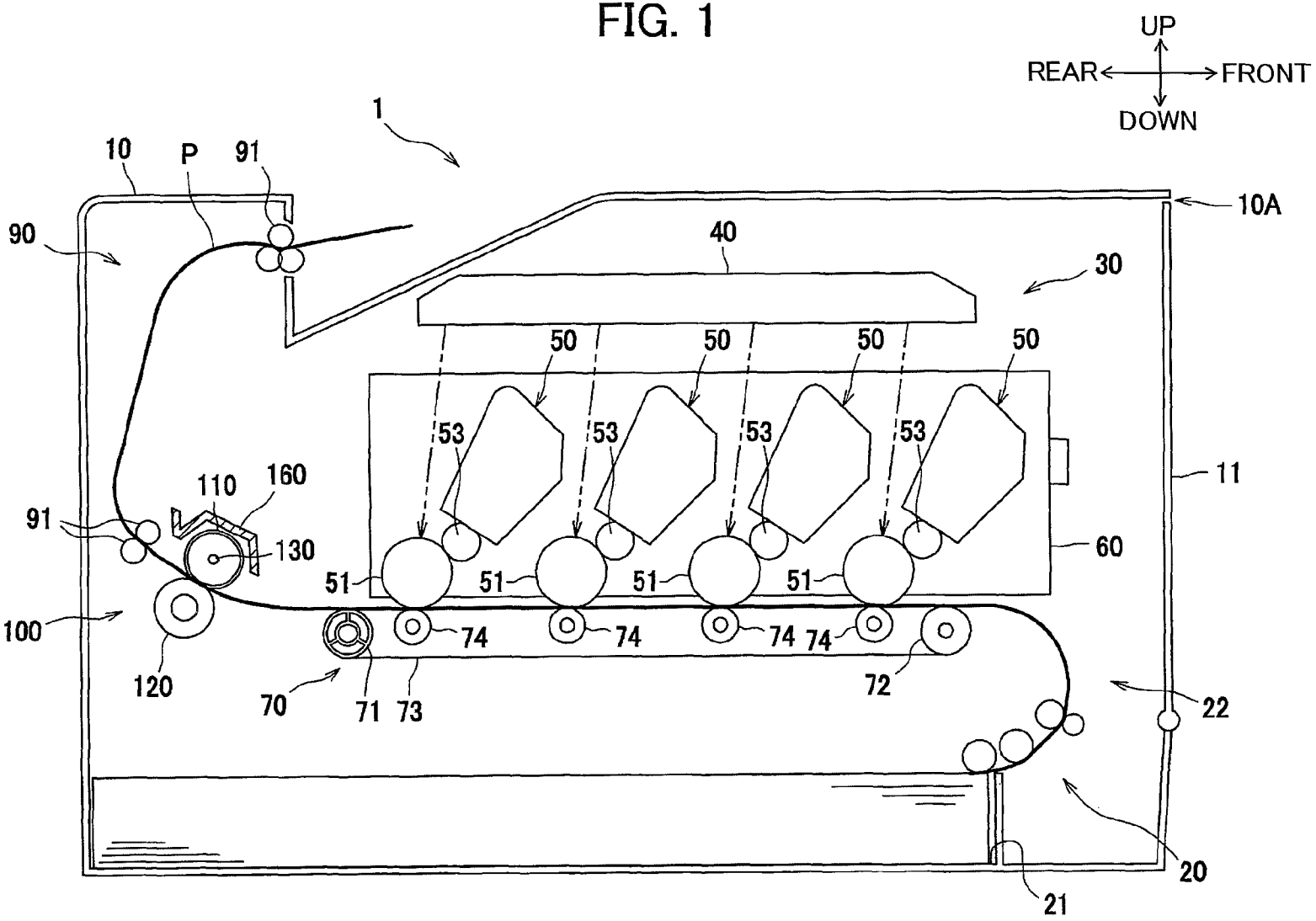
FIG. 1 is a side cross-sectional view illustrating a general configuration of a color printer incorporating a fixing device according to an embodiment of the present invention.

As shown in FIG. 1, the color printer 1 includes a main frame 10. The main frame 10 has a front surface at which a front cover 11 is pivotably movably provided. When the front cover 11 is opened, an opening 10A is defined in the front surface of the main body 10.

Within the main frame 10, a sheet-feeding unit 20 for supplying sheets of paper P, an image-forming unit 30 for forming images on the supplied sheets P, and a discharge unit 90 for discharging the image-formed sheets P.

The sheet-feeding unit 20 includes a sheet tray 21 accommodating the sheets P and a sheet-conveying mechanism 22 for conveying the sheets P from the sheet tray 21 to the image-forming unit 30.

The image-forming unit 30 includes a scanner unit 40, four process cartridges 50, a holder 60, a transfer unit 70, and the fixing device 100.

The scanner unit 40 is provided in an upper portion of the main frame 10. While not shown in the drawings, the scanner unit 40 includes a laser light-emitting portion, a polygon mirror, lenses and reflecting mirrors. Laser beams emitted from the scanner unit 40 are irradiated in a high-speed over surfaces of respective photosensitive drums 51 (described later), as indicated by two-dot chain lines shown in FIG. 1.

The process cartridges 50 are arrayed in a front-rear direction and disposed above the sheet-feeding unit 20. Each process cartridge 50 includes one photosensitive drum 51, a charger of a well-known configuration (not shown), a developing roller 53 and a toner accommodation chamber (not shown).

The holder 60 is configured to integrally support the four process cartridges 50. The holder 60 is movable with respect to the front-rear direction relative to the main frame 10 through the opening 10A.

The transfer unit 70 is disposed between the sheet-feeding unit 20 and the four process cartridges 50 in the up-down direction. The transfer unit 70 includes a drive roller 71, a follow roller 72, a conveyer belt 73, and four transfer rollers 74.

The drive roller 71 and follow roller 72 are arranged parallel to each other and spaced apart from each other in the front-rear direction. The conveyer belt 73 is an endless belt that is stretched taut and mounted over the drive roller 71 and follow roller 72. Four of the transfer rollers 74 are disposed in a loop formed by the conveyer belt 73 at positions opposing the respective photosensitive drums 51 such that the conveyer belt 73 is nipped between the transfer rollers 74 and corresponding photosensitive drums 51.

The fixing device 100 is disposed rearward of the four process cartridges 50 and the transfer unit 70. Details of the fixing device 100 will be described later in detail.

In the image-forming unit 30 configured as described above, first, the surface of each photosensitive drum 51 is uniformly charged by the corresponding charger, and subsequently exposed to light by the laser beam from the scanner unit 40. Exposed areas are given an electric potential lower than other areas on the surface, thereby resulting in formation of an electrostatic latent image on the surface of each photosensitive drum 51. Next, toner within the toner accommodation chamber is supplied to the electrostatic latent image on the surface of each photosensitive drum 51 from the corresponding developing roller 53, by which a toner image is formed on the surface of each photosensitive drum 51.

As a sheet P supplied onto the conveyer belt 73 passes between each photosensitive drum 51 and each transfer roller 74, the toner image formed on each photosensitive drum 51 is sequentially transferred onto the sheet P. The toner images transferred onto the sheet P are then thermally fixed to the sheet P at the fixing device 100.

The discharge unit 90 includes a plurality of conveying rollers 91 for conveying the sheets P. After the toner images have been transferred and fixed to the sheet P, the conveying rollers 91 convey the sheet P out of the main frame 10.

<Structure of the Fixing Device>

The fixing device 100 includes a heat roller 110 as an example of a tubular body, a pressure roller 120, a heater 130, and a frame 160 supporting the heat roller 110.

Figures 2A, 2B:
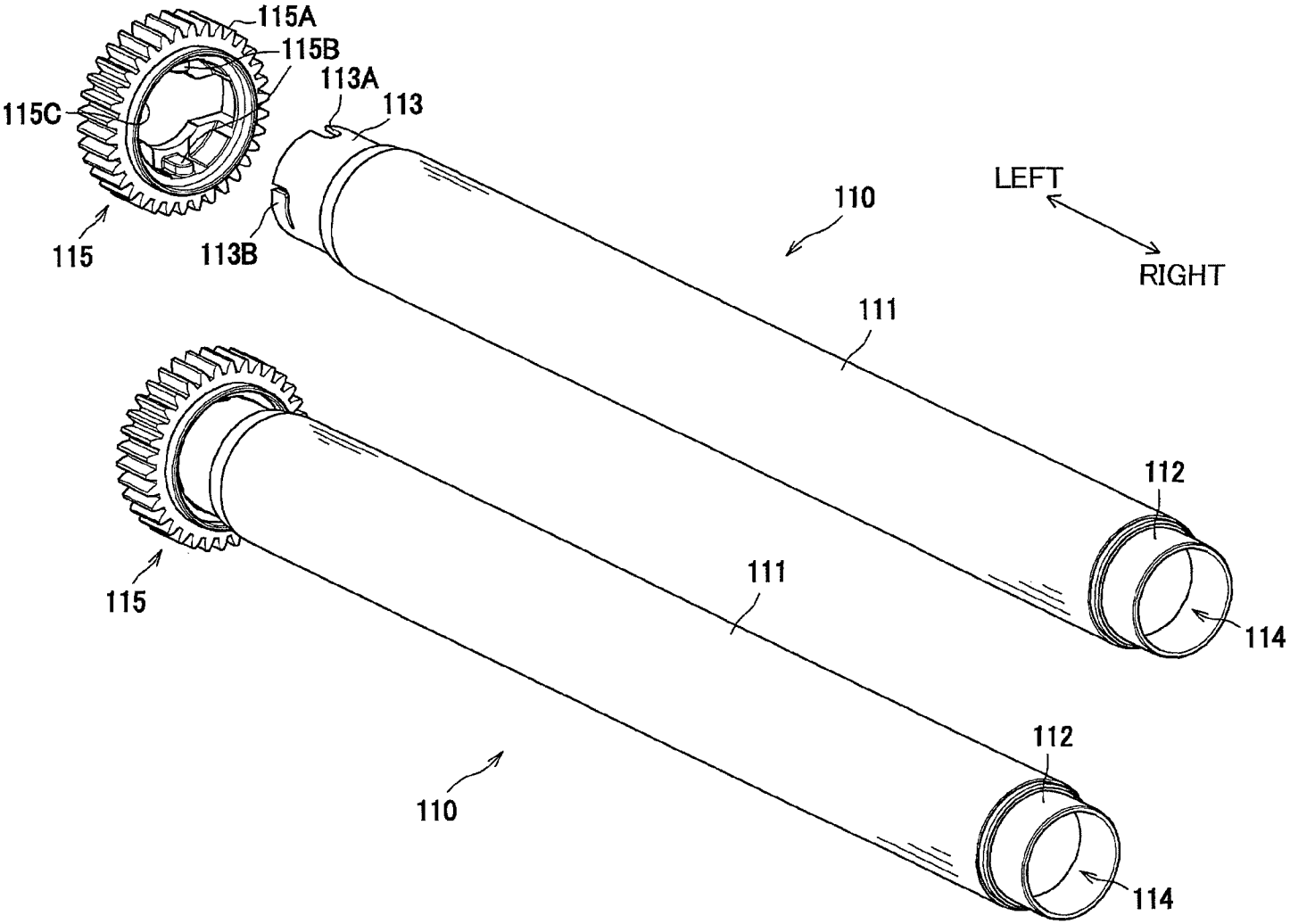
FIG. 2A is a perspective view showing a heat roller and a gear of the fixing device of the embodiment in an exploded state.
FIG. 2B is a perspective view showing the heat roller and the gear assembled in an assembled state.

As shown in FIG. 2A, the heat roller 110 includes a metallic base tube of a hollow cylindrical shape and a photosensitive layer 111 provided on an outer peripheral surface of the metallic base tube. Further, as shown in FIGS. 2A and 2B, a gear 115 is fitted to the base tube of the heat roller 110.

The base tube is elongated in a left-right direction and defines an axis extending in an axial direction parallel to the left-right direction. The base tube (heat roller 110) has a right end portion 112 and a left end portion 113. The photosensitive layer 111 is not provided on each of the right end portion 112 and left end portion 113. Although not shown in the drawings, a bearing is fitted to each of the right end portion 112 and left end portion 113. An end opening 114 is defined in each of the right end portion 112 and left end portion 113. Each end opening 114 is open outward in the axial direction (rightward or leftward).

The left end portion 113 has a left edge on which a pair of end concave portions 113A and a pair of crimping portions 113B are formed. The end concave portions 113A are recessed, from the left edge of the left end portion 113, inward in the left-right direction. The end concave portions 113A are positioned to diametrically oppose each other and function to prevent rotation of the gear 115 relative to the left end portion 113. In FIG. 2A, only one of the end concave portions 113A is illustrated. The two crimping portions 113B are formed to diametrically oppose each other such that each crimping portion 113B is positioned between the two opposing end concave portions 113A. The crimping portions 113B are crimped to the gear 115.

The gear 115 is made of a resin and is configured to receive a drive force for rotating the heat roller 110. As shown in FIG. 2A, the gear 115 is generally ring-like shaped. Specifically, the gear 115 has an inner peripheral surface that defines a fitting hole 115C and an outer peripheral surface on which a gear portion 115A is formed. The gear 115 is fitted to the left end portion 113 at the fitting hole 115C. Further, two protrusions 115B are formed on the inner peripheral surface defining the fitting hole 115C to protrude radially inward therefrom. The two protrusions 115B are positioned to be coincident with the end concave portions 113A of the left end portion 113, respectively.

The gear 115 is fitted to the left end portion 113 with the protrusions 115B coupled to the end concave portions 113A. The crimping portions 113B of the left end portion 113 are then crimped toward the inner peripheral surface of the gear 115, thereby fixing the gear 115 to the heat roller 110, as shown in FIG. 2B. The drive force is thus transmitted from the gear 115 to the heat roller 110 to rotate the heat roller 110.

As shown in FIG. 1, the pressure roller 120 is disposed to oppose the heat roller 110 and is biased toward the heat roller 110 by a biasing force of, for example, a spring.

The heater 130 is configured to generate radiant heat to heat the heat roller 110. The heater 130 extends in the left-right direction and is inserted, through one of the end openings 114, into an internal space of the heat roller 110. The heater 130 is thus disposed in the internal space of the heat roller 110.

Figures 3A, 3B, 3C:
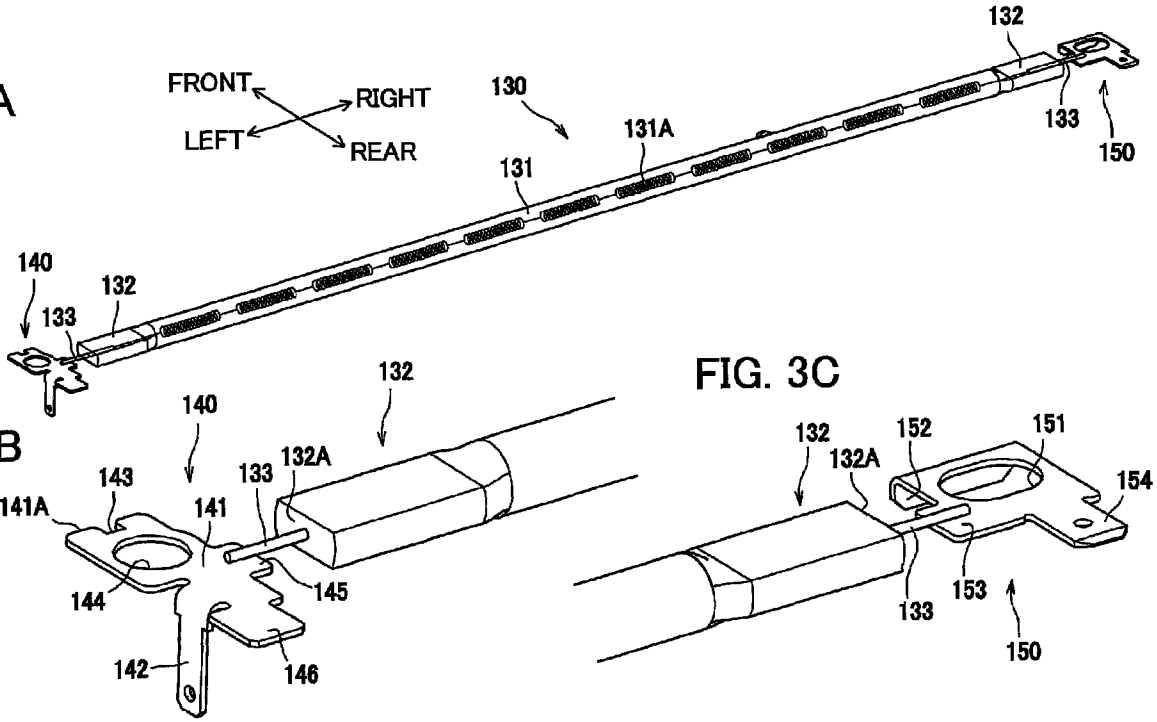
FIG. 3A is a perspective view of a heater of the fixing device of the embodiment, the heater having a left terminal and a right terminal.
FIG. 3B is an enlarged perspective view of the left terminal of the fixing device of the embodiment.
FIG. 3C is an enlarged perspective view of the right terminal of the fixing device of the embodiment.

Referring to FIG. 3A, the heater 130 includes a generally cylindrical-shaped hollow tube 131 elongated in the left-right direction (also see FIG. 11) and a filament 131A as an example of a heat generating element. The filament 131A is disposed in an internal hollow space of the tube 131. The heater 130 is manufactured by encapsulating inert gas including halogen within the tube 131 with the filament 131A positioned inside the filament 131A and with both end portions 132 of the tube 131 sealed. The heater 130 also includes a pair of electrically conductive pins 133, a left terminal 140 and a right terminal 150 as an example of a terminal. The pins 133 are formed of a metal. Each pin 133 is provided at each end portion 132 of the tube 131. More specifically, each end portion 132 has an end face 132A from which the corresponding pin 133 protrudes outward in the left-right direction. Each pin 133 has a protruding end that is fixed to the left terminal 140 or to the right terminal 150, by welding, for example.

<Structure of the Terminals>

As shown in FIG. 3B, the left terminal 140 includes a main body 141. The main body 141 is formed of a metal and has a rectangular flat plate-like shape extending in the front-rear direction.

The main body 141 includes a protruding portion 142, a terminal recess 143, a hole 144, a pin connection portion 145 and a terminal extending portion 146.

The protruding portion 142 is configured to be connected to a connector of a wire from a circuit board (now shown). The protruding portion 142 is formed by bending a left-rear end portion of the main body 141 to protrude downward in FIG. 3B. The terminal recess 143 is formed at a left-right center of a front end 141A of the main body 141. The terminal recess 143 is recessed rearward from the front end 141A. The hole 144 is formed rearward of the terminal recess 143 in the main body 141. The pin connection portion 145 extends rightward from a generally center of a right end of the main body 141. The terminal extending portion 146 extends rearward from a rear end of the main body 141.

As illustrated in FIG. 3C, the right terminal 150 is formed of a metal and has a rectangular flat plate-like shape. The right terminal 150 includes a hole 151, a bent portion 152, a pin connection portion 153, and a right terminal extending portion 154.

The hole 151 is formed in a substantial center portion of the right terminal 150 and has an oblong shape elongated in the left-right direction. The bent portion 152 is provided by bending a front end portion of the right terminal 150 downward in FIG. 3C. The pin connection portion 153 extends leftward from a left-rear end portion of the right terminal 150. The right terminal extending portion 154 extends rearward from a rear-right end portion of the right terminal 150. In the right terminal 150, the right terminal extending portion 154 is connected to a connector of a wiring from the circuit substrate (not shown).

The left terminal 140 is fixed to the frame 160 via a left film 200 as an example of an insulating member. The right terminal 150 is fixed to the frame 160 via a right film 210 as an example of a plate-like member and as another example of the insulating member. Details of the left film 200 and right film 210 will be described later.

<Structure of the Frame>

Figure 4:
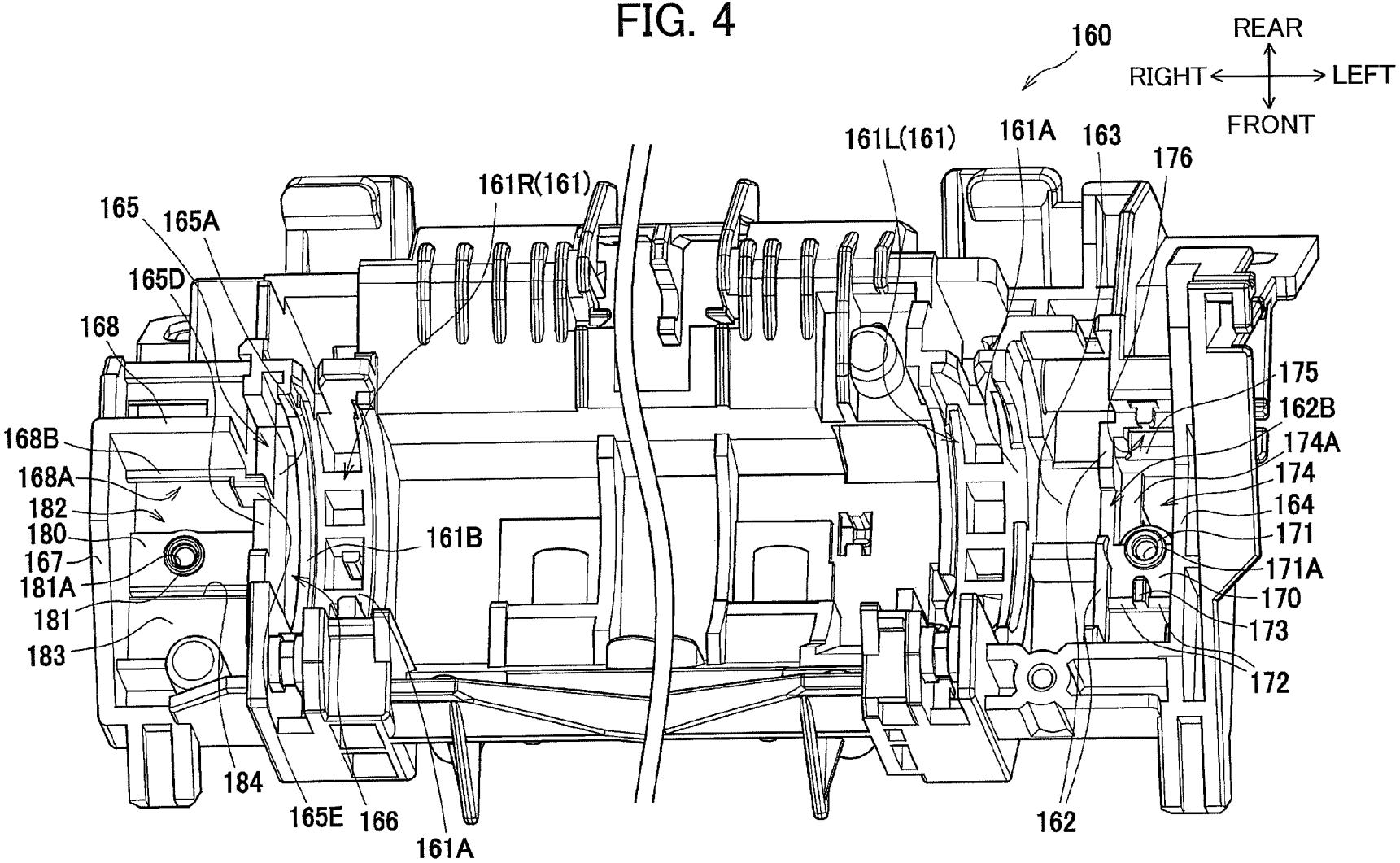
FIG. 4 is a perspective view of a frame of the fixing device of the embodiment as viewed from its lower front side.

The frame 160 is formed of glass-fiber-reinforced polyethylene terephthalate, i.e., glass-fiber reinforced resin. As illustrated in FIG. 1, the frame 160 is disposed to cover the heat roller 110 from above. As illustrated in FIG. 4, the frame 160 is elongated in the left-right direction. The frame 160 has left and right end portions in each of which a bearing support portion 161 is formed for supporting the bearing (not shown) of the heat roller 110. Hereinafter, whenever necessary, the bearing support portion 161 formed at the left end portion of the frame 160 is referred to as a left bearing support portion 161L, while the bearing support portion 161 formed on the right end portion of the frame 160 is referred to as a right bearing support portion 161R. Each of the bearing support portions 161L and 161R has a support surface 161A having a semicircular-shaped cross-section. The both support surfaces 161A are formed to receive the right end portion 112 and left end portion 113 of the heat roller 110, respectively.

Referring to FIG. 4, on the left end portion of the frame 160, a first left wall 162, a second left wall 164 and a left fixing surface 170 are provided. The first left wall 162 extends in the front-rear direction and positioned leftward of the left bearing support portion 161L. The second left wall 164 extends in the front-right direction and is arranged leftward of the first left wall 162 to be spaced away therefrom. The left fixing surface 170 is formed between the first left wall 162 and second left wall 164. The first left wall 162 is arranged to be spaced away from the left bearing support portion 161L in the left-right direction so that the gear 115 can be disposed therebetween. The left bearing support portion 161L and first left wall 162 are connected via a connection portion 163.

The left fixing surface 170 is a surface to which the left terminal 140 is attached. The left fixing surface 170 is an example of an attachment surface. The left fixing surface 170 is formed to be coincident with the main body 141 (in particular, a front-side portion thereof) of the left terminal 140. The left fixing surface 170 is formed with a left engagement portion 171 at a position coincident with the hole 144 of the left terminal 140. The left engagement portion 171 has a cylindrical shape protruding downward (toward the left terminal 140) and has an outer diameter smaller than that of the hole 144. The left fixing surface 170 has a screw hole 171A formed therein for receiving a screw. In FIG. 4, the near side corresponds to the lower side of the color printer 1.

The left fixing surface 170 has a front end portion on which a front wall 172 is formed to protrude downward therefrom. The front wall 172 has a left-right center portion on which an engagement protrusion 173 is provided to protrude downward therefrom. The engagement protrusion 173 is positioned to be coincident with the terminal recess 143 of the left terminal 140. The engagement protrusion 173 is an example of an engagement portion.

The engagement protrusion 173 protrudes not only downward but also rearward from the left-right center portion of the front wall 172. With this structure, the engagement protrusion 173 can be engaged with the terminal recess 143 of the left terminal 140.

A first opening 174 is formed at a position rearward of and adjacent to the left fixing surface 170 and rearward of the left engagement portion 171 in the front-rear direction and between the first left wall 162 and second left wall 164 in the left-right direction. The first opening 174 is in a form of a through-hole extending vertically so that the protruding portion 142 of the left terminal 140 can be received at the first opening 174 when the left terminal 140 is attached to the left fixing surface 170.

The first left wall 162 and second left wall 164 protrude further downward than the left fixing surface 170 does. The first left wall 162 is divided into front and rear sections to provide a concave portion 162B therebetween. The concave portion 162B is adapted to allow the pin 133 of the left terminal 140 to be received in the concave portion 162B. The first left wall 162 has a left wall from which a protruding wall 174A protrudes leftward. The protruding wall 174A has such a protruding length not to reach the protruding portion 142 of the left terminal 140 disposed in the first opening 174.

A wall 175 is formed to the rear of the first opening 174 and between the first left wall 162 and second left wall 164 in the left-right direction. The wall 175 defines a rear edge of the first opening 174. A second opening 176 is further formed rearward of the wall 175 and between the first left wall 162 and second left wall 164 in the left-right direction. The second opening 176 is open rearward and is positioned to be coincident with the terminal extending portion 146 of the left terminal 140. The second opening 176 is thus adapted to receive a leading end portion (rear end portion) of the terminal extending portion 146 of the left terminal 140 when the left side terminal 140 is attached to the left fixing surface 170. The second opening 176 is an example of an opening.

Referring also to FIG. 4, on the right end portion of the frame 160, a first right wall 165 (as an example of a first wall), a second right wall 167 (as an example of a second wall), and a right fixing surface 180 are formed. The second right wall 167 is positioned rightward of the first right wall 165. The right fixing surface 180 is formed between the first right wall 165 and second right wall 167.

The first right wall 165 is formed rightward of the right bearing support portion 161R. The first right wall 165 extends in the front-rear direction. The right bearing support portion 161R has a right end 161B positioned rightward of the right support surface 161A. The first right wall 165 and the right end 161B of the right bearing support portion 161R define a groove 166 therebetween.

The first right wall 165 is positioned closest to the right end portion 112 of the heat roller 110 assembled to the frame 160. The first right wall 165 has a left surface 165A as an example of a first surface (see FIG. 11).

Figure 5A:
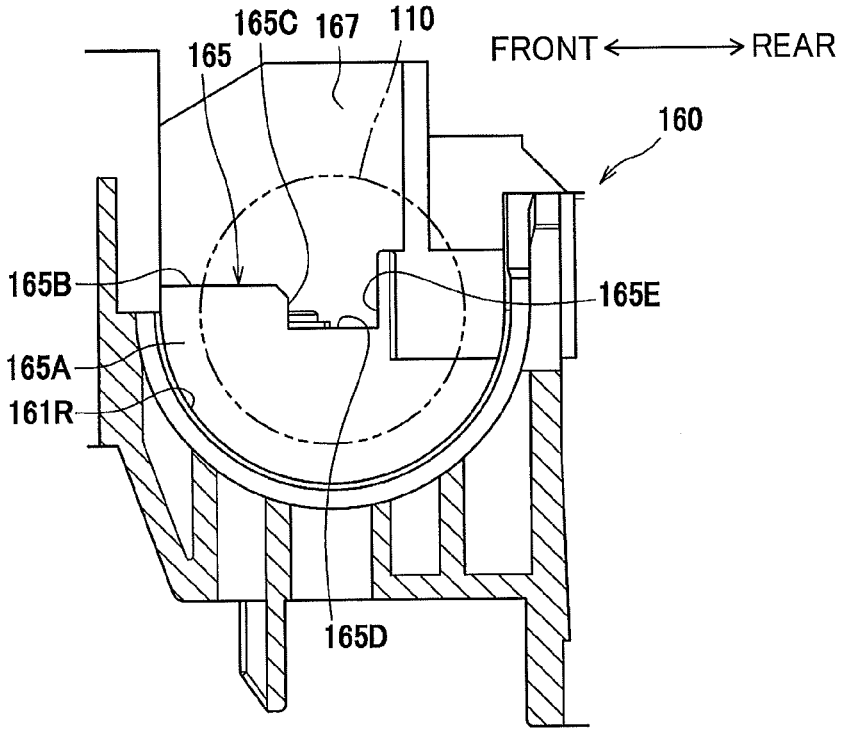
FIG. 5A is a view showing a first right wall of the frame of the embodiment as viewed from the heart roller side, wherein a right film is removed from the frame.

More specifically, as illustrated in FIG. 5A, the first right wall 165 has a first edge 165B, a second edge 165C, a third edge 165D and a fourth edge 165E. The first edge 165B extends rearward from a position corresponding to a front end of the right bearing support portion 161R. The second edge 165C extends from a rear end of the first edge 165B downward in FIG. 5A. The third edge 165D extends rearward from a lower end (in FIG. 5A) of the second edge 165C. The fourth edge 165E extends upward in FIG. 5A from a rear end of the third edge 165D.

The third edge 165D is disposed to oppose the pin connection portion 153 of the right terminal 150 mounted in the frame 160 in the left-right direction. The fourth edge 165E extends further upward in FIG. 5A than the first edge 165B does. The fourth edge 165E has an upper end in FIG. 5A that is positioned uppermost in the first right wall 165.

The second right wall 167 extends in the front-rear direction and constitutes a right end of the frame 160.

The right fixing surface 180 is a surface to which the right terminal 150 and right film 210 are fixed. The right fixing surface 180 is another example of the attachment surface. The right fixing surface 180 has a right engagement portion 181 as an example of an engaging portion at a position coincident with the hole 151 of the right terminal 150. The right engagement portion 181 has a cylindrical shape protruding downward (toward the right terminal 150). The right engagement portion 181 has an outer diameter smaller than a minor axis of the hole 151. The right engagement portion 181 is formed with a screw hole 181A therein for receiving a screw.

A first receiving portion 182 is provided rearward of and adjacent to the right fixing surface 180 and between the first right wall 165 and second right wall 167 in the left-right direction. The first receiving portion 182 is recessed, relative to the right fixing surface 180, in a direction opposite to the right terminal 150 mounted on the right fixing surface 180.

A rear wall 168 is positioned rearward of the first receiving portion 182. The rear wall 168 has a front surface in which a third opening 168A is formed at a position coincident with the right terminal extending portion 154 of the right terminal 150.

The third opening 168A is designed to receive the right terminal extending portion 154 of the right terminal 150 mounted on the right fixing surface 180. Further, the front surface of the rear wall 168 is further formed with a peripheral portion 168B protruding frontward therefrom. This peripheral portion 168B is connected to the fourth edge 165E of the first right wall 165.

On the right end portion of the frame 160, a surface 183 is further provided frontward of the right fixing surface 180 and between the first right wall 165 and second right wall 167 in the left-right direction. Between the right fixing surface 180 and the surface 183, a second receiving portion 184 is formed. The second receiving portion 184 is in a form of a groove and is configured to receive the bent portion 152 of the right terminal 150 fixed to the right fixing surface 180.

<Structure of the Left Film>

Next, the left film 200 will be described.

The left film 200 is configured to cover the left terminal 140 and the pin 133 connected thereto. The left film 200 is formed of heat resistant polyimide resin.

Figure 6A:
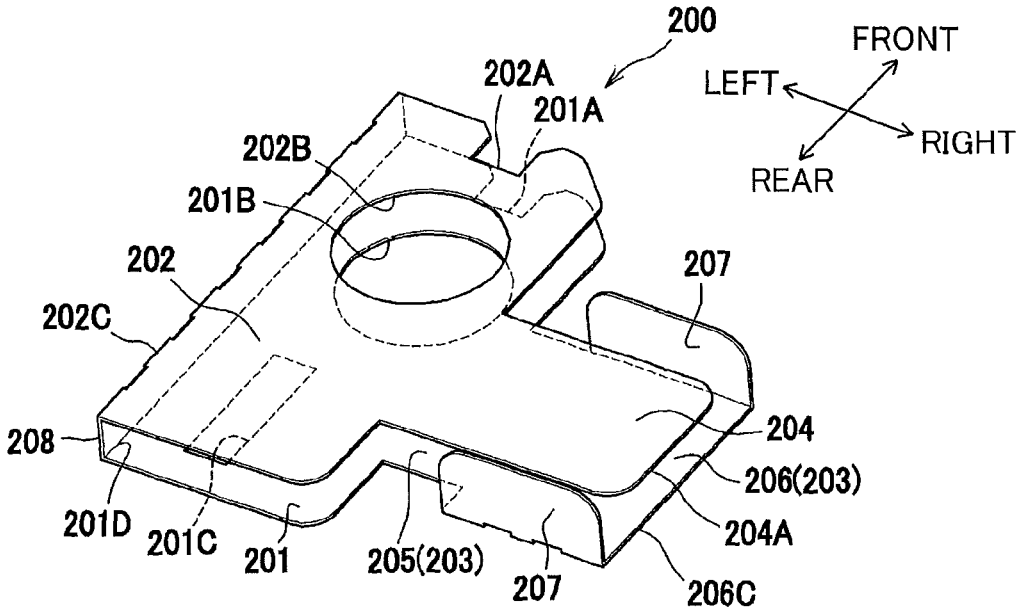
FIG. 6A is a perspective view of a left film of the embodiment.
Figure 6B:
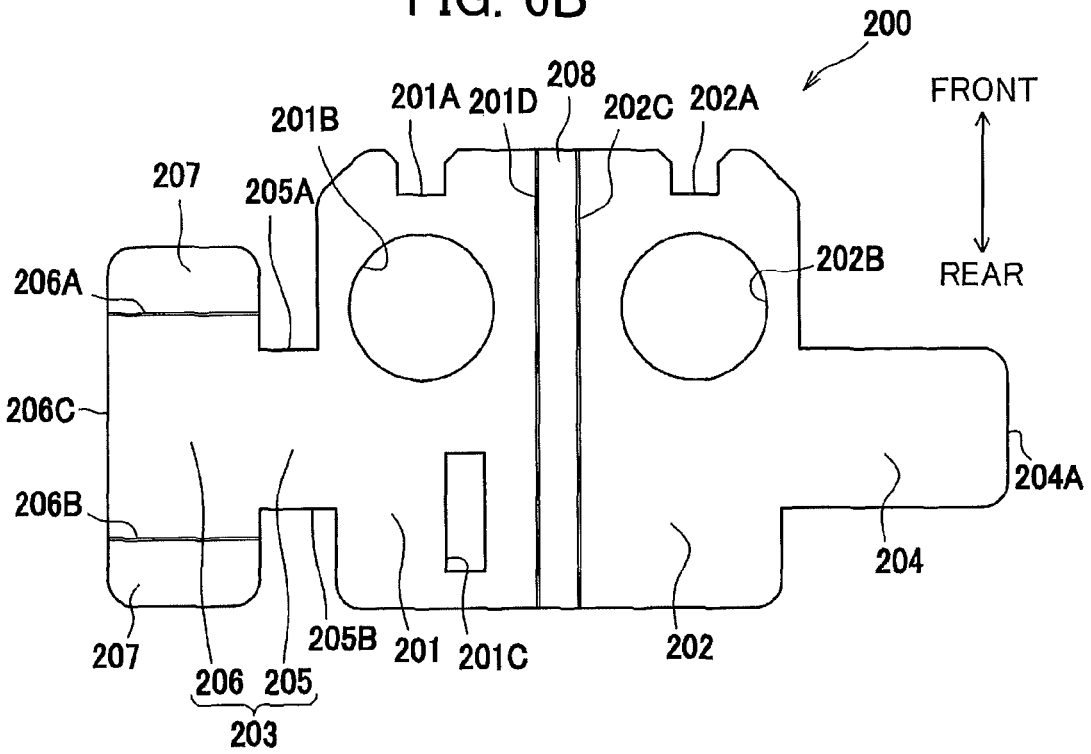
FIG. 6B is an exploded view of the left film of the embodiment.

As illustrated in FIGS. 6A and 6B, the left film 200 includes a first fixing portion 201 (as an example of a first portion and as an example of a first fixing portion), a second fixing portion 202 (as an example of a second portion and as an example of a second fixing portion), and a connection portion 208 connecting between the first fixing portion 201 and second fixing portion 202. Each of the first fixing portion 201 and second fixing portion 202 is fixed to the left fixing surface 170. The first and second fixing portions 201, 202 are formed in a rectangular shape having substantially the same size as that of the main body 141 of the left terminal 140. Thus, when attached to the left terminal 140, the first fixing portion 201 and second fixing portion 202 overlap with the main body 141.

The first fixing portion 201 is disposed at the left fixing surface 170 side of the left terminal 140 (i.e., the first fixing portion 201 is positioned between the left fixing surface 170 and the left terminal 140). The first fixing portion 201 includes a first concave portion 201A, a circular first hole 201B and a through-hole 201C. The first concave portion 201A is recessed rearward from a general center position on a front end portion of the first fixing portion 201. The first hole 201B is positioned rearward of the first concave portion 201A. The through-hole 201C is formed in a rear portion of the first fixing portion 201.

The second fixing portion 202 is disposed opposite to the first fixing portion 201 with respect the left terminal 140. The second fixing portion 202 includes a second concave portion 202A and a circular second hole 202B. The second concave portion 202A is recessed rearward from a general center position on a front end portion of the second fixing portion 202. The circular second hole 202B is positioned rearward of the second concave portion 202A.

The first and second concave portions 201A and 202A are positioned to be coincident with the terminal recess 143 of the left terminal 140. The first and second holes 201B and 202B are positioned to be coincident with the hole 144 of the left terminal 140. Each of the first and second holes 201B and 202B has substantially the same size as that of the hole 144 of the left terminal 140. The through-hole 201C is arranged at a position coincident with the protruding portion 142 of the left terminal 140. The through-hole 201C penetrates the rear portion of the first fixing portion 201.

The first fixing portion 201 further includes a first covering portion 203 extending rightward (direction from the left terminal 140 toward the pin 133) from a generally center position on a right end portion of the first fixing portion 201. Similarly, the second fixing portion 202 also includes a second covering portion 204 extending rightward (direction from the left terminal 140 toward the pin 133) from a generally center position on a right end portion of the second fixing portion 202. The first and second covering portions 203 and 204 are configured to cover the left pin 133 from above and from below. The first and second covering portions 203 and 204 are thus formed to be coincident with the pin connection portion 145 of the left terminal 140 and pin 133. A reference numeral 201D denotes a left end of the first fixing portion 201, and a reference numeral 202C denotes a left end of the second fixing portion 202.

The first covering portion 203 includes a narrow portion 205 and a wide portion 206. The narrow portion 205 is a portion where the pin connection portion 145 is positioned when the left film 200 is attached to the left terminal 140. The wide portion 206 is a portion where the pin 133 is positioned when the left film 200 is attached to the left terminal 140. The wide portion 206 has a front-rear width wider than that of the second covering portion 204. That is, the first covering portion 203 is larger in width than the second covering portion 204 at the portion where the pin 133 is positioned (i.e., at the wide portion 206). A reference numeral 205A in FIG. 6B denotes a front end of the narrow portion 205, and a reference numeral 205B denotes a rear end of the narrow portion 205.

The wide portion 206 includes a pair of extending portions 207. Specifically, the wide portion 206 has a front end 206A and a rear end 206B from each of which one extending portion 207 extends toward the second fixing portion 202. Perforations are provided along the front end 206A and rear end 206B, and bending along the perforations provides the extending portions 207.

The connection portion 208 is integrally formed with the first and second fixing portions 201 and 202, as illustrated in FIG. 6B. Specifically, perforations are provided along the left end 201D of the first fixing portion 201 and left end 202C of the second fixing portion 202. Bending along the perforations provides the connection portion 208.

The wide portion 206 has a right end 206C, whereas the second covering portion 204 has a right end 204A. As shown in FIG. 6A, the right end 206C of the wide portion 206 and the right end 204A of the second covering portion 204 are arranged to be positioned at the substantially same position in the left-right direction.

<Attachment of the Left Film to the Left Terminal>

How the left film 200 is attached to the left terminal 140 will now be described.

Figure 7A:
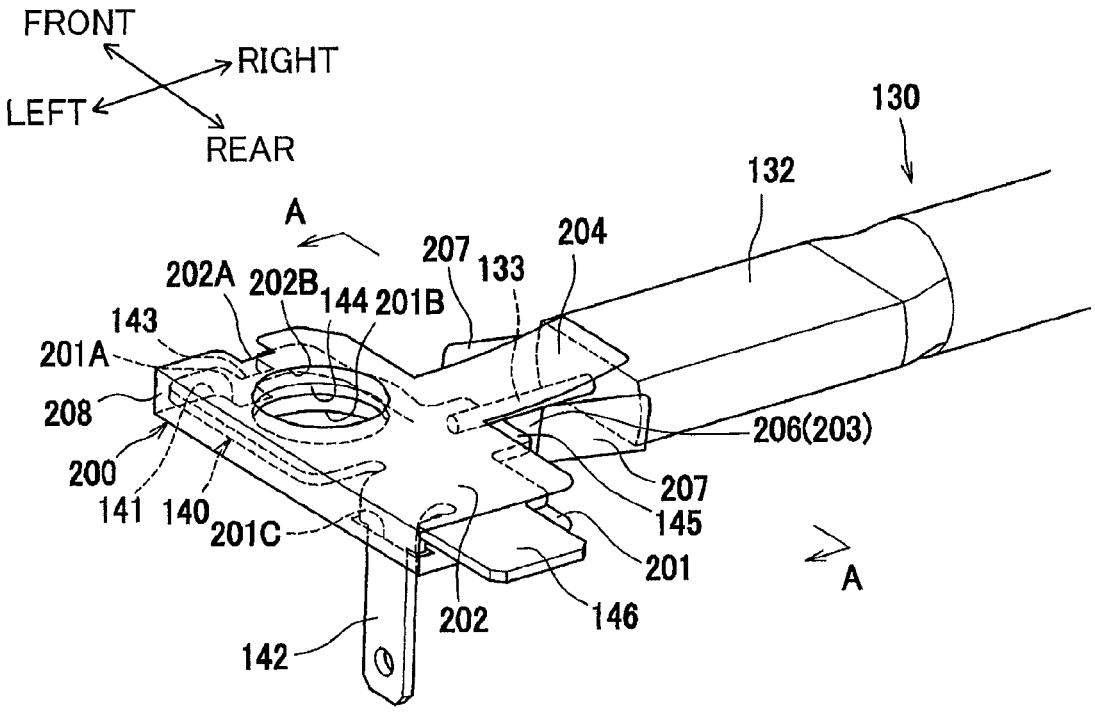
FIG. 7A is a partially enlarged perspective view of the left terminal of the embodiment, wherein the left film is attached to the left terminal.

Although not shown in the drawings, the left film 200 with each portion bent along the perforations (as shown in FIG. 7A) is opened such that the second fixing portion 202 is separated away from the first fixing portion 201. The wide portion 206 and pin 133 are brought close to each other such that the pin 133 is positioned at the wide portion 206. At this time, the pin 133 is inserted between the two protruding extending portions 207, by which the pin 133 is positioned at the wide portion 206. Subsequently, the protruding portion 142 of the left terminal 140 is made to penetrate the through-hole 201C of the first fixing portion 201. Positioning of the left film 200 relative to the left terminal 140 is thus obtained, thereby preventing displacement of the left film 200 relative to the left terminal 140.

Then, the second fixing portion 202 is then brought close to the first fixing portion 201. The left film 200 is assembled to the left terminal 140 such that the left terminal 140 is sandwiched between the first fixing portion 201 and second fixing portion 202.

Figure 7B:
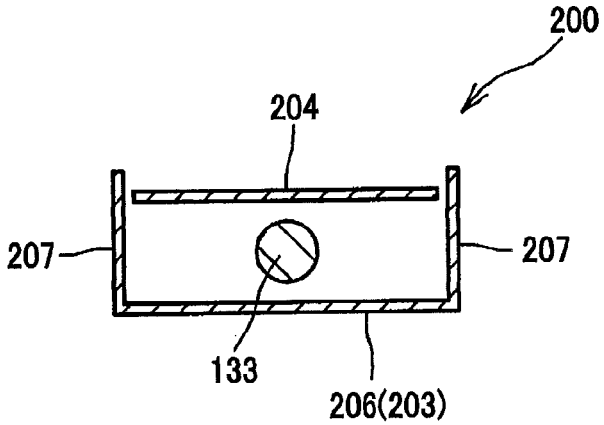
FIG. 7B is a cross-sectional view of the left terminal covered with the left film taken along a plane A-A shown in FIG. 7A, wherein a pin of the left terminal is surrounded by covering portions and extending portions of the left film.

As a result of assembly, the pin 133 is enclosed, from four sides, as shown in FIG. 7B. Specifically, the pin 133 is positioned between the wide portion 206 of the first covering portion 203 and the second covering portion 204 in the up-down direction, and between the pair of extending portions 207 in the front-rear direction.

Further, as illustrated in FIG. 7A, in the up-down direction (or a direction in which the left terminal 140 and left film 200 oppose each other), the wide portion 206 of the first covering portion 203 and the second covering portion 204 are overlapped with a portion of the end portion 132 of the heater 130. In other words, the pin 133 is completely surrounded by the left film 200 in the up-down direction by the first covering portion 203 and the second covering portion 204.

When the left film 200 is assembled to the left terminal 140, the left film 200 overlaps with the main body 141 of the left terminal 140 but does not overlap with the terminal extending portion 146 of the left terminal 140. That is, the terminal extending portion 146 protrudes from the coverage by the left film 200, thereby realizing arrangement of the terminal extending portion 146 without interference with the left film 200.

<Structure of the Right Film>

Figure 8A:
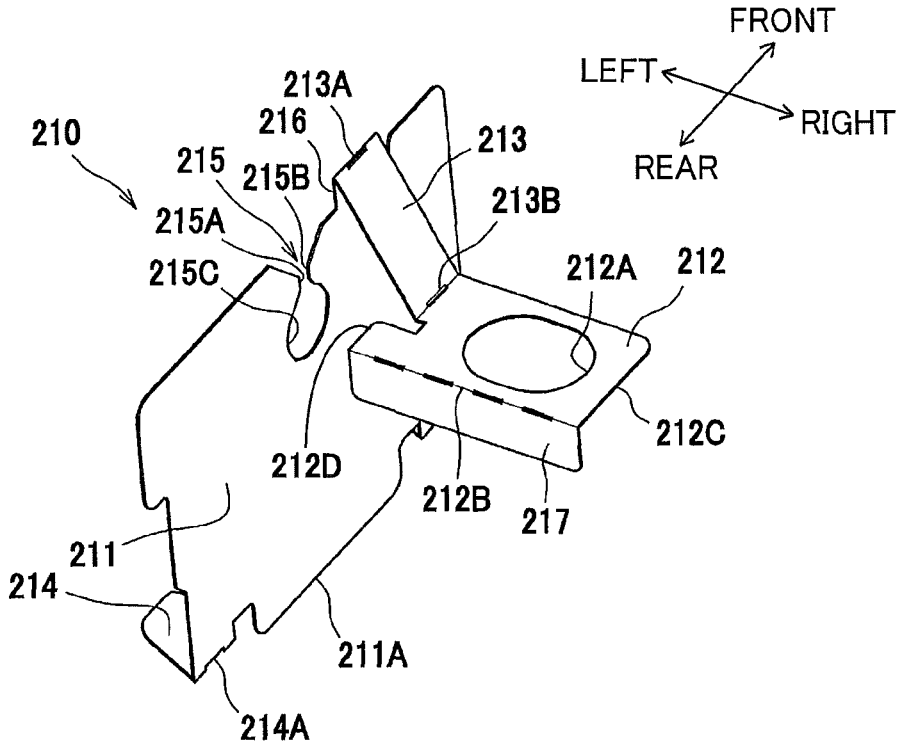
FIG. 8A is a perspective view of the right film of the embodiment.
Figure 8B:
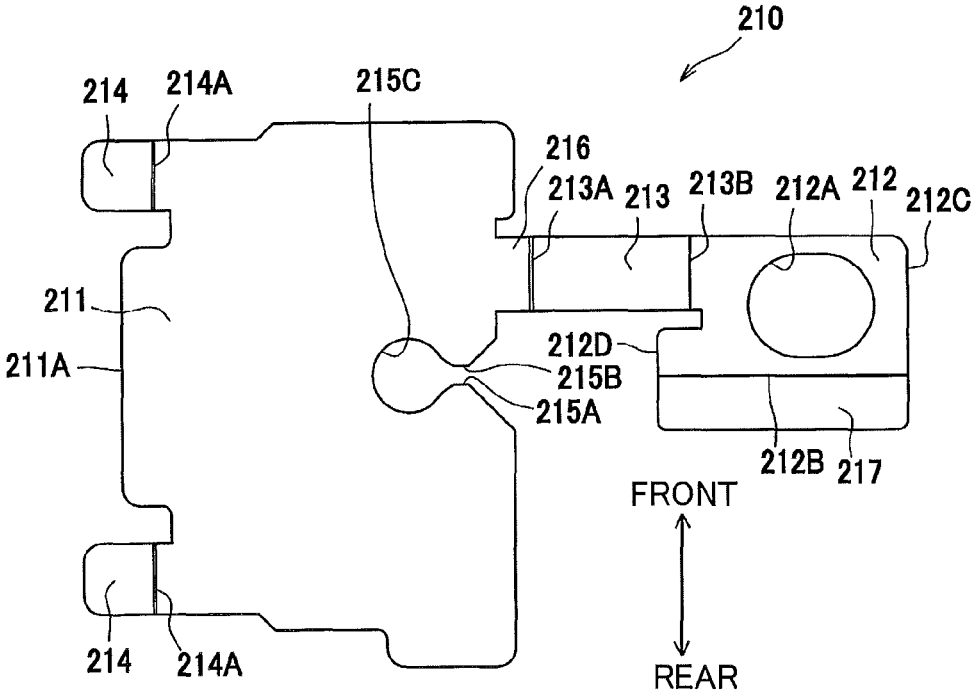
FIG. 8B is an exploded view of the right film of the embodiment.

Next, details of the right film 210 will be described with reference to FIGS. 8A and 8B.

The right film 210 is formed of heat resistant polyimide resin. As illustrated in FIGS. 8A and 8B, the right film 210 includes a heat shield portion 211, a fixing portion 212 and a connection portion 213 connecting between the heat shield portion 211 and fixing portion 212. Here, a vertical direction with regard to the right film 210 will be referred to based on the vertical direction in FIG. 8A.

The heat shield portion 211 is generally rectangular shaped. The heat shield portion 211 has a lower end portion that is adapted to be received in the groove 166 of the right end portion of the frame 160. A pair of bent portions 214 is provided on the lower end portion of the heat shield portion 211 one at respective front and rear end portions thereof. The heat shield portion 211 is an example of a shielding portion.

For fabricating the bent portions 214, the front and rear end portions of the lower portion of the heat shield portion 211 are respectively bent leftward (toward the heat roller 110). Each bent portion 214 thus has an edge 214A along which the bent portion 214 is bent relative to the heat shield portion 211. A center peripheral portion 211A is also provided on the lower end portion of the heat shield portion 211 at a position generally center thereof in the front-rear direction. The center peripheral portion 211A has a lower edge positioned lower than the edge 214A of each bent portion 214.

The heat shield portion 211 has an upper end portion in which a pin opening 215 and a grip portion 216 are formed. The pin opening 215 is adapted to receive the pin 133 connected to the right terminal 150. The pin opening 215 is formed at a front-rear center of the upper end portion of the heat shield portion 211. Specifically, the pin opening 215 has a rear edge 215A, a front edge 215B and an arcuate edge 215C. The rear edge 215A and front edge 215B extend downward from the upper end portion of the heat shield portion 211 and oppose each other to define therebetween a gap large enough to allow the pin 133 to pass therethrough. The arcuate edge 215C is connected to lower ends of the rear and front edges 215A and 215B. The arcuate edge 215C is generally circular shaped in a side view.

The grip portion 216 is formed frontward of the pin opening 215 on the upper end portion of the heat shield portion 211. Specifically, the grip portion 216 is a protrusion provided on an upper edge of the upper end portion of the heat shield portion 211. The grip portion 216 protrudes upward in FIG. 8A (i.e., protrudes upward relative to the first right wall 165, see FIG. 5B). The grip portion 216 has an upper end that is connected to a left end 213A of the connection portion 213. In other words, the heat shield portion 211 is connected to the connection portion 213 at the grip portion 216.

The fixing portion 212 is configured to be fixed to the right fixing surface 180. The fixing portion 212 has a rectangular shape substantially the same as that of the right terminal 150 such that the fixing portion 212 is overlapped with the right terminal 150. The fixing portion 212 is formed with a hole 212A smaller than the hole 151 as an example of a fixation opening. The hole 212A is formed to be coincident with the hole 151. The hole 212A is configured to be engaged with the right engagement portion 181 when the fixing portion 212 is mounted on the right fixing surface 180.

The fixing portion 212 has a front-left end that is connected to a right end 213B of the connection portion 213. The fixing portion 212 has a rear-left end 212D that is positioned further leftward relative to the right end 213B of the connection portion 213. The fixing portion 212 has a rear end edge 212B along which a perforation is provided. Bending along the perforation downward in FIG. 8A (away from the right terminal 150) provides an extending portion 217.

The extending portion 217 is positioned to be coincident with the first receiving portion 182 of the frame 160. The extending portion 217 is configured to be received in the first receiving portion 182 when the fixing portion 212 is mounted on the right fixing surface 180.

The connection portion 213 is integrally formed with the heat shield portion 211 and fixing portion 212. Bending the connection portion 213 rightward relative to the heat shield portion 211 along the perforation (left end 213A), and then bending the fixing portion 212 upward relative to the connection portion 213 along the perforation (right end 213B) provide the right film 210 as shown in FIG. 8A.

<Mounting of the Right Film to the Frame>

Figure 9:
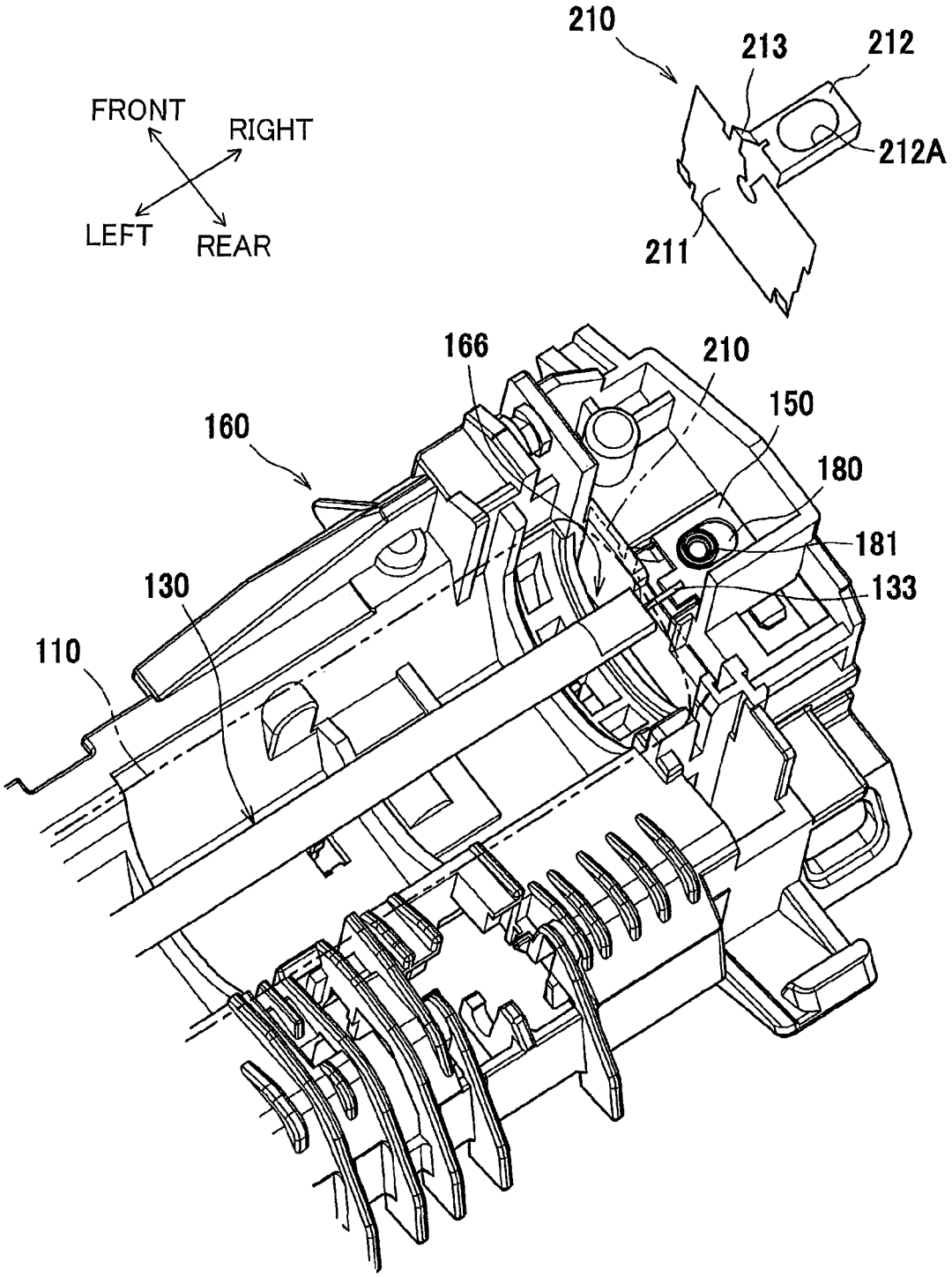
FIG. 9 is a partial perspective view showing the frame of the embodiment, wherein the right film is removed from the frame.
Figure 11:
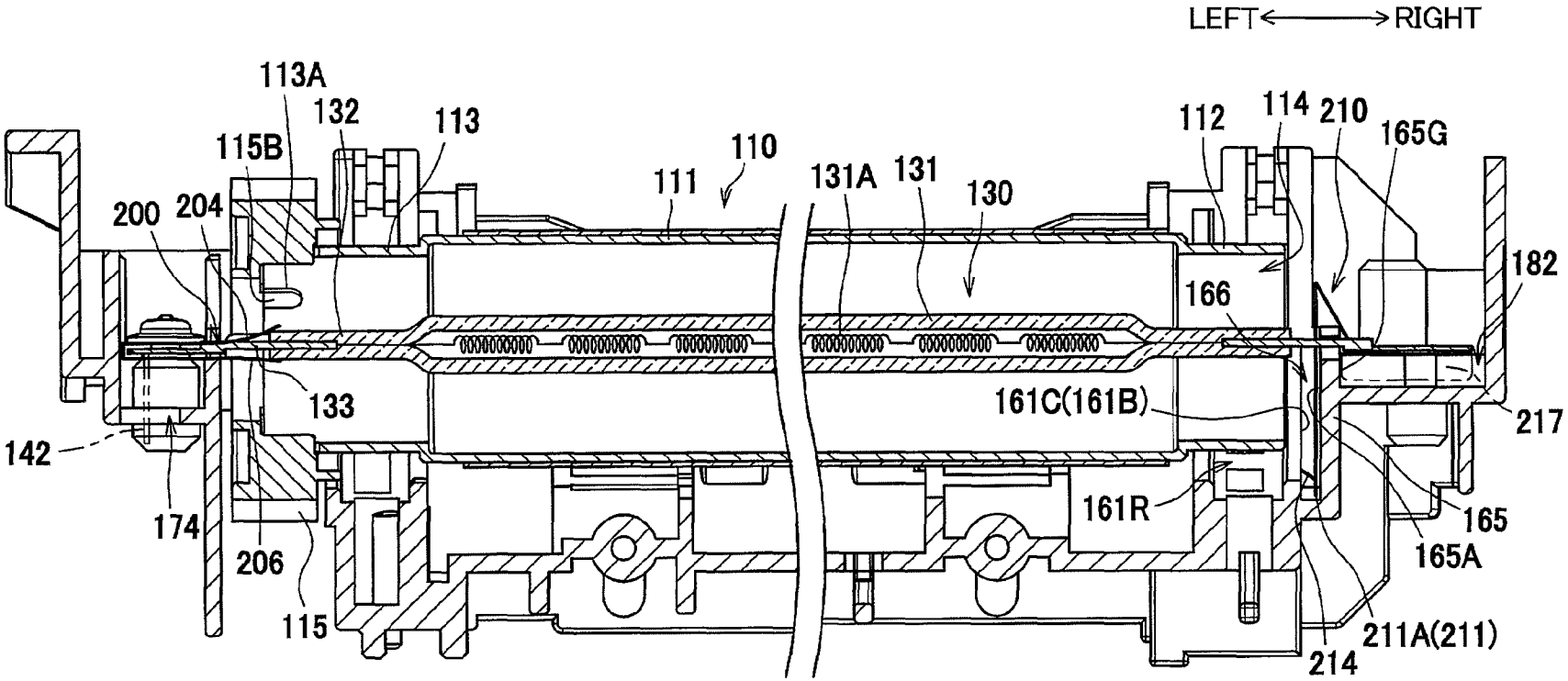
FIG. 11 is a partial cross-sectional view of the frame of the embodiment of FIG. 10A taken along a plane C-C shown in FIG. 10A.

As illustrated in FIG. 9, the above-described right film 210 is mounted onto the frame 160 such that the heat shield portion 211 is inserted into the groove 166 of the frame 160 from above in the figure. As a result, as shown in FIG. 11, the center peripheral portion 211A and both bent portions 214 are disposed within the groove 166 such that leading ends of the bent portions 214 are in contact with a right surface 161C of the right end 161B of the bearing support portion 161R. The bent portions 214 thus function to urge the heat shield portion 211 toward the left surface 165A of the first right wall 165, thereby reliably separating the heat shield portion 211 from the heat roller 110.

Figure 5B:
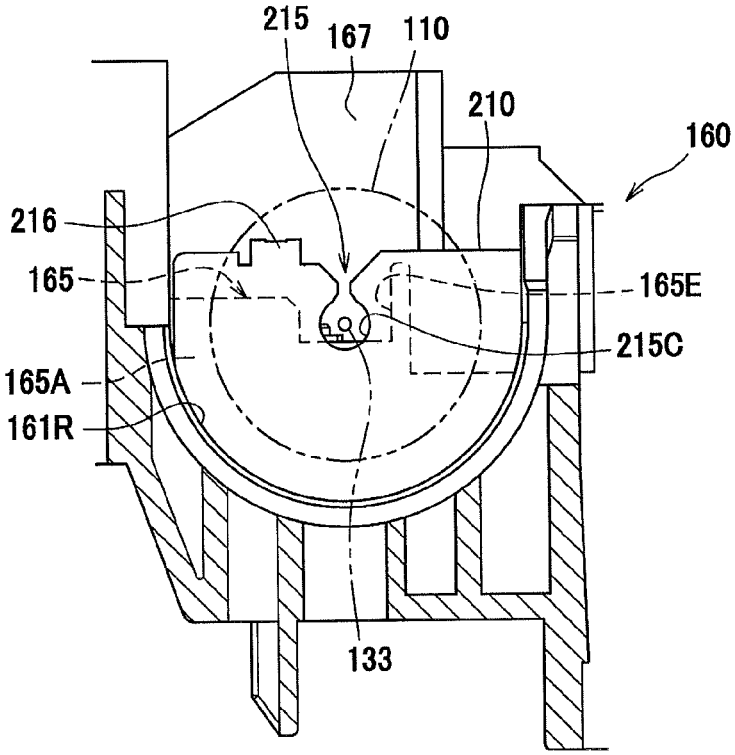
FIG. 5B is a view showing the first right wall of the frame of the embodiment as viewed from the heart roller side, wherein the right film is attached to the frame.

As illustrated in FIG. 5B, when placed on the frame 160, the heat shield portion 211 protrudes upward in the FIG. 5B relative to the first right wall 165. Also, when placed on the frame 160, the heat shield portion 211 substantially covers the first right wall 165, but a part of the first right wall 165 that faces the pin opening 215 is not covered by the heat shield portion 211 as viewed from the heat roller 110 side (from the right side), as shown in FIG. 5B.

Figures 10A, 10B, 10C:
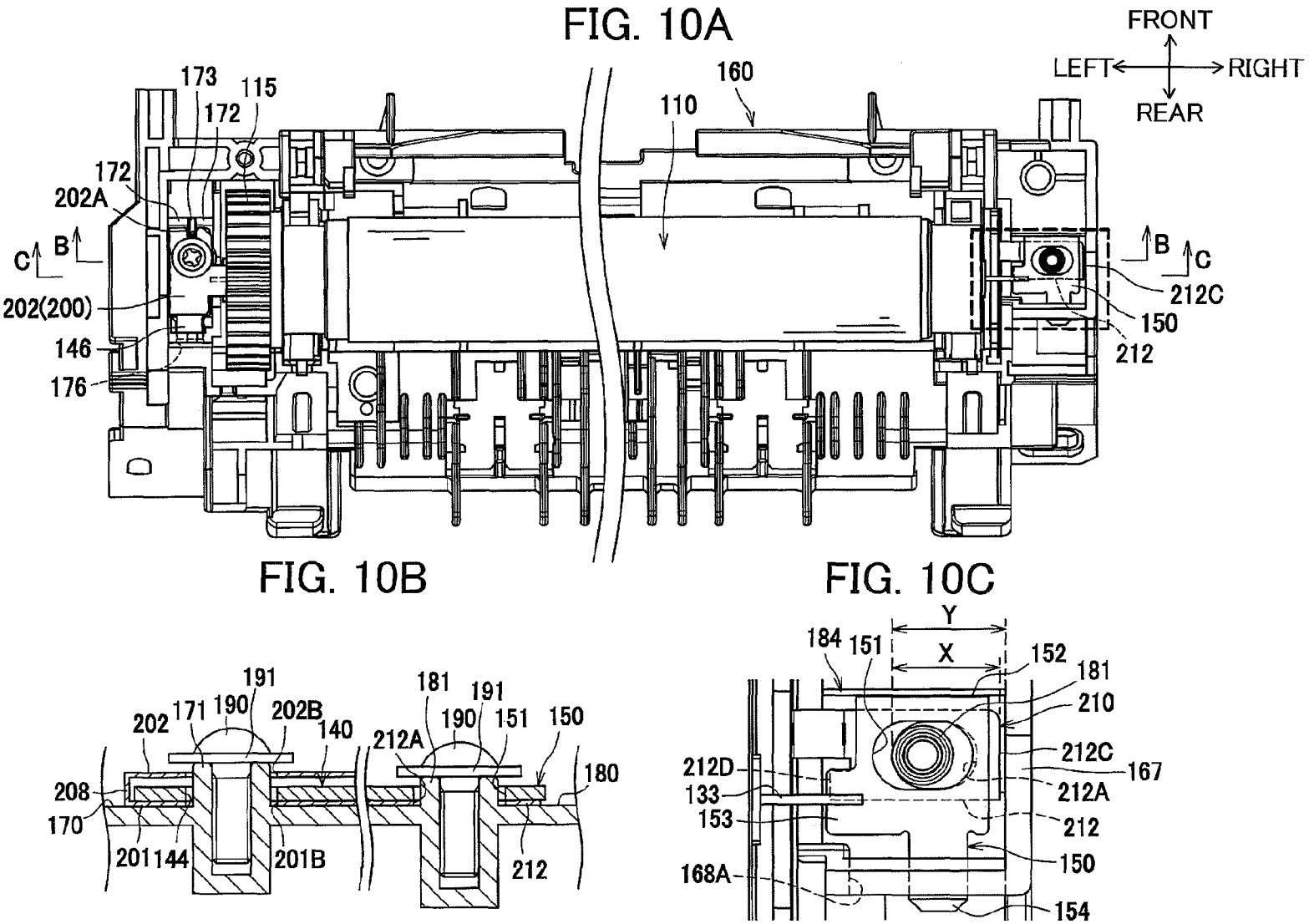
FIG. 10A is a bottom view of the frame of the embodiment, wherein the heat roller and the heater are assembled to the frame.
FIG. 10B is a partially-enlarged cross-sectional view showing screwed portions of the frame of the embodiment taken along a plane B-B shown in FIG. 10A.
FIG. 10C is an enlarged view of an area of the frame of the embodiment near the right terminal enclosed by a dashed line in FIG. 10A.

As illustrated in FIG. 10C, the fixing portion 212 is disposed on the right fixing surface 180 such that the hole 212A is engaged with the right engagement portion 181. When the hole 212A of the right film 210 is engaged with a left end of the right engagement portion 181, a left edge of the hole 212A is caused to be engaged with the right engagement portion 181 due to a resilient restoring force of the connection portion 213 trying to move rightward relative to the heat shield portion 211. Here, assuming that: a distance from a position where the hole 212A and right engagement portion 181 are engaged to a right edge 212C of the fixing portion 212 (an edge opposite to the heater 130 with respect to the hole 212A) is defined as a distance X (as an example of a first distance); and a distance from the position of engagement between the hole 212A and right engagement portion 181 to the second right wall 167 is defined as a distance Y (as an example of a second distance), the distance X is shorter than the distance Y. With this structure, the fixing portion 212 can be fixed to the right fixing surface 180 without interfering with the second right wall 167.

As illustrated in FIG. 11, the extending portion 217 of the fixing portion 212 is received in the first receiving portion 182. With this configuration, if the fixing portion 212 attempts to move rightward, the extending portion 217 abuts against a right surface 165G of the first right wall 165, thereby restricting the fixing portion 212 from moving in the left-right direction. Thus, displacement of the fixing portion 212 relative to the right terminal 150 can be restrained.

After the right film 210 is placed on the frame 160, the heater 130 penetrating through the heating roller 11 is arranged in the frame 160.

<Fixing of the Terminals to the Frame>

How the left terminal 140 (to which the left film 200 has been attached) is fixed to the frame 160 will be described.

As illustrated in FIG. 10A, first, the terminal extending portion 146 of the left film 200 is inserted into the second opening 176, and as illustrated in FIG. 11, the protruding portion 142 is inserted into the first opening 174.

Figure 12A:
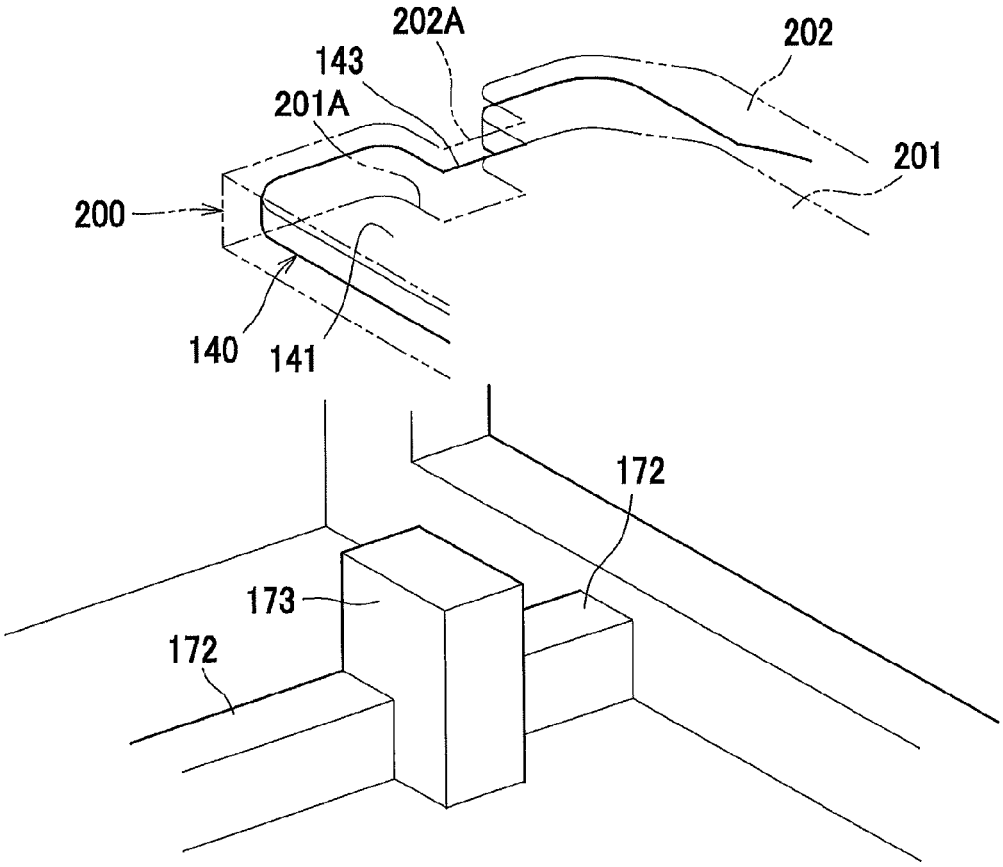
FIG. 12A is an explanatory view showing a state before a first concave portion of the left film, a terminal concave portion of the left terminal, and a second concave portion of the left film are engaged with an engagement protrusion of the frame of the embodiment.
Figure 12B:
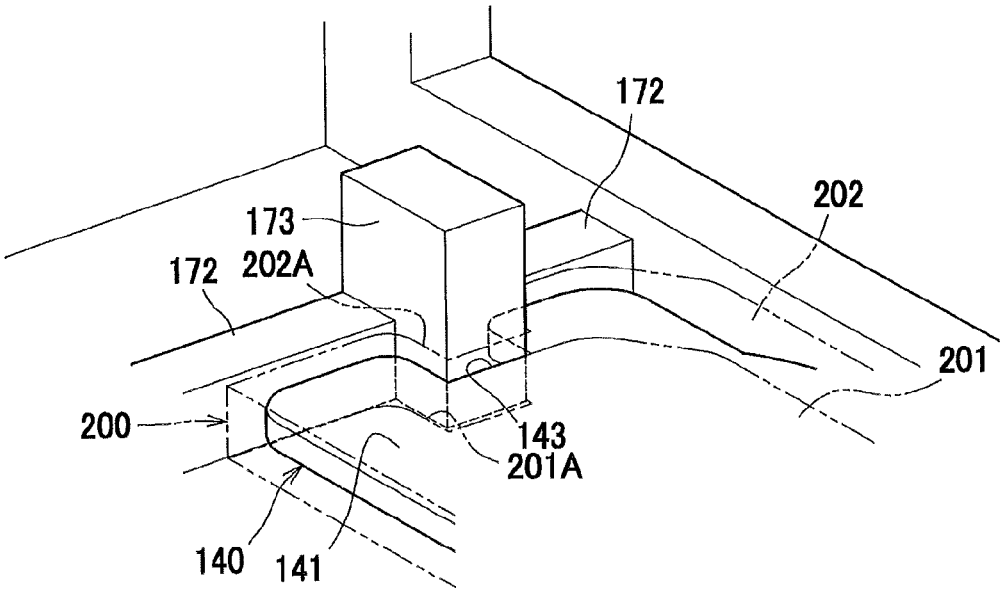
FIG. 12B is an explanatory view showing a state after the first concave portion of the left film, the terminal concave portion of the left terminal, and the second concave portion of the left film are engaged with the engagement protrusion of the frame of the embodiment.

Then, as illustrated in FIG. 10B, the left engagement portion 171 is inserted into the first hole 201B of the left film 200, the hole 144 and the second hole 202B of the left film 200. Further, as illustrated in FIGS. 12A and 12B, the second concave portion 202A of the left film 200, the terminal recess 143, and the first concave portion 201A of the left film 200 are engaged with the engagement protrusion 173. The left terminal 140 and left film 200 are thus positioned accurately relative to the left fixing surface 170.

Then, a screw 190 penetrating a washer 191 is screwed into the screw hole 171A of the left engagement portion 171, thereby fastening the left terminal 140 and left film 200 to the left fixing surface 170. In this way, the first fixing portion 201 of the left film 200 can be disposed between the left terminal 140 and left fixing surface 170.

Referring to FIG. 11, when the left terminal 140 has been assembled to the frame 160 as described above, the left pin 133 connected with the left terminal 140 is positioned to be aligned with a position where the heat roller 110 and gear 115 are engaged with each other in the left-right direction, i.e., arranged at the same position as the position at which the end concave portions 113A of the left end portion 113 of the heat roller 110 and protrusions 115B of the gear 115 are engaged with one another.

Next, how the right terminal 150 is fixed to the frame 160 will be described.

As illustrated in FIG. 10C, the right terminal extending portion 154 is inserted into the third opening 168A such that the right engagement portion 181 penetrates the hole 151. Then, the bent portion 152 is inserted into the second receiving portion 184 to have the right terminal 150 placed on the fixing portion 212 of the right film 210 that has been disposed on the right fixing surface 180.

Further, as illustrated in FIG. 5B, the right pin 133 connected with the right terminal 150 is placed within the arcuate edge 215C of the pin opening 215 through the gap formed between the rear edge 215A and front edge 215B. Within the pin opening 215, the right pin 133 is positioned so as not to contact the arcuate edge 215C.

Then, as illustrated in FIG. 10B, a screw 190 penetrating a washer 191 is screwed into the screw hole 181A of the right engagement portion 181, thereby fastening the right film 210 and right terminal 150 to the right fixing surface 180. In this manner, the fixing portion 212 of the right film 210 is disposed between the right terminal 150 and right fixing surface 180.

<Technical Advantages>

With the structure of the above-described embodiment, the following technical advantages can be obtained.

The heat shield portion 211 of the right film 210 is disposed in the groove 166. The heat shield portion 211 can therefore prevent the radiant heat of the heater 130 from being conveyed to the right end portion of the frame 160 (the portion located rightward toward the right terminal 150 from the heat shield portion 211). The temperature of the right end portion of the frame 160 (the portion located near the end opening 114 of the heat roller 110) can be prevented from becoming too high, and generation of UFPs can be restrained accordingly. Further, due to the provision of the pin opening 215 in the heat shield portion 211, arrangement of the heat shield portion 211 between the heater 130 and right terminal 150 can be facilitated.

Further, the heat shield portion 211 can easily be assembled to the frame 160 simply by fitting the heat shield portion 211 into the groove 166.

The bent portions 214 ensure separation of the heat shield portion 211 from the heat roller 110, as shown in FIG. 11. In other words, the heat shield portion 211 can be separated from the heat roller 110 through a simple configuration.

Further, the heat shield portion 211 almost covers the first right wall 165 but the portion of the first right wall 165 facing the pin opening 215 is not covered by the heat shield portion 211, as shown in FIG. 5B. This structure contributes to suppression of the temperature of the first right wall 165 from rising too high.

Further, as shown in FIG. 5B, the heat shield portion 211 protrudes higher relative to the first right wall 165. This protruding heat shield portion 211 can further suppress transmission of the radiant heat. Further, since the heat shield portion 211 includes the grip portion 216, holding of the heat shield portion 211 can be facilitated.

The right film 210 of the embodiment integrally includes the fixing portion 212 and the connection portion 213. Thus, fixing of the fixing portion 212 to the frame 160 can prevent inadvertent coming-off of the heat shield portion 211.

Further, in the embodiment, the left film 200 is disposed between the left terminal 140 and left fixing surface 170, and the right film 210 is disposed between the right terminal 150 and right fixing surface 180. This structure can serve to suppress an excessive increase in temperatures of the left and right fixing surfaces 170 and 180. Generation of UFPs can also be restrained.

Further, the left film 200 is fixed to the left fixing surface 170 together with the left terminal 140, and the right film 210 is fixed to the right fixing surface 180 together with the right terminal 150. Hence, assembly of the left film 200 and right film 210 to the frame 160 can be simplified, compared to a structure where films and terminals are fixed separately.

By covering the left terminal 140 with the left film 200 in a sandwiched manner, the left film 200 can be easily attached to the left terminal 140. Further, the left terminal 140 covered with the left film 200 can be assembled to the left fixing surface 170 of the frame 160 with ease.

Further, in the embodiment, the protruding portion 142 penetrates the through-hole 201C to realize positioning of the left film 200 relative to the left terminal 140. The left film 200 is thus unlikely to be displaced relative to the left terminal 140, thereby further inhibiting the temperature of the left fixing surface 170 from becoming too high.

Likewise, in the right film 210, the extending portion 217 can suppress displacement of the fixing portion 212 relative to the right terminal 150. Excessive temperature increase in the right fixing surface 180 can also be suppressed.

The left and right films 200 and 210 may have the same configuration as each other. Or left/right positions of the left and right films 200 and 210 may be switched to each other. Still alternatively, only one of the left and right films 200 and 210 may be provided on the frame 160.

Moreover, the left pin 133 is covered by the first and second covering portions 203 and 204 of the left film 200 of the embodiment, as shown in FIG. 7B. Insulation property of the pin 133 in the heater 130 can be maintained.

Further, the left pin 133 is surrounded from all four directions by the left film 200, thereby facilitating sustaining of the insulation property of the pin 133 in the heater 130.

The extending portions 207 extend from the wide portion 206 of the first covering portion 203 that is disposed between the left fixing surface 170 and left terminal 140. The wide portion 206 and pin 133 are naturally aligned with each other, facilitating disposition of the left terminal 140 on the left film 200.

The pin 133 is completely covered by the first covering portion 203 and second covering portion 204. The insulation property of the pin 133 can be maintained with ease.

Since the penetration of the protruding portion 142 through the through-hole 201C can prevent displacement of the left film 200 relative to the left terminal 140, the pin 133 is prevented from being exposed to outside from the first covering portion 203 and second covering portion 204.

Incidentally, as shown in FIG. 11, the pin 133 is arranged at the same position in the left-right direction as the position where the heat roller 110 and gear 115 are engaged with each other. If the heat roller 110 is damaged at this engagement position between the heat roller 110 and gear 115, metal pieces or fragments may come off and fall and possibly cause contact with the pin 133. In the present embodiment, however, since the pin 133 is covered by the left film 200, contact between metal fragments and the pin 133 can be prevented and the insulation property of the pin 133 can be sustained.

The left terminal 140, right terminal 150 and frame 160 may be of any shape, as long as the above-described technical advantages are realized. Further, the heat shield portion 211 need not be a film, but may be configured of a material other than a film. For example, the heat shield portion 211 may be a thin plate-like member. Further, the heat shield portion 211 may be provided near the left terminal 140, instead of near the right terminal 150.

The heat shield portion 211 as an example of the shielding portion of the insulating member may have a thickness of, for example, between 0.03 mm and 5.00 mm, or between 0.05 mm and 3.00 mm, or between 0.05 mm and 1.50 mm, or between 0.07 mm and 1.00 mm, or between 0.10 mm and 0.50 mm.

Various modifications and variations are conceivable.

Figure 13A:
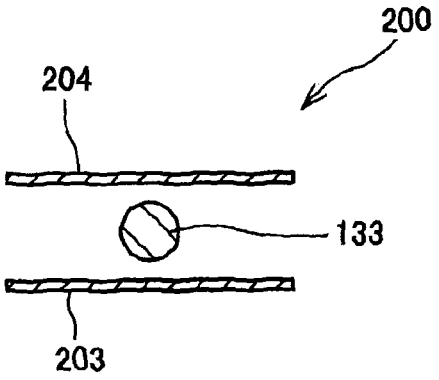
FIG. 13A is an explanatory view of a left film according to a variation of the embodiment.

For example, the left film 200 of the embodiment includes the pair of extending portions 207. However, as illustrated in FIG. 13A, the left film 200 may not be provided with the extending portions 207.

Further, the left film 200 of the embodiment has the first covering portion 203 and second covering portion 204. However, the second covering portion 204 may not be provided in the left film 200.

Figure 13B:
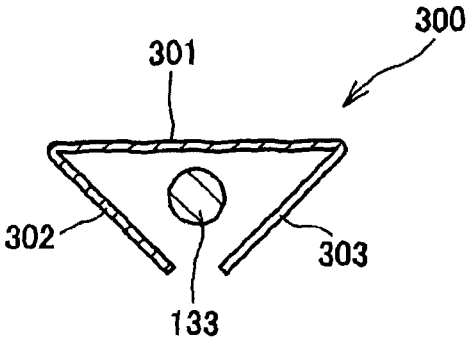
FIG. 13B is an explanatory view of a left film according to a first modification to the embodiment.

For example, FIG. 13B shows a left film 300 according to a first modification to the depicted embodiment. The left film 300 includes a covering portion 301, and a pair of extending portions 302 and 303. The extending portions 302, 302 are provided by bending both end portions of the covering portion 301.

More specifically, the extending portion 302 is provided by bending the left end portion of the covering portion 301 diagonally downward and rightward in FIG. 13B. Likewise, the extending portion 303 is provided by bending the right end portion of the covering portion 301 diagonally downward and leftward in FIG. 13B. With this structure as well, the pin 133 can be surrounded (covered) by the covering portion 301 and the extending portions 302 and 303.

Figure 13C:
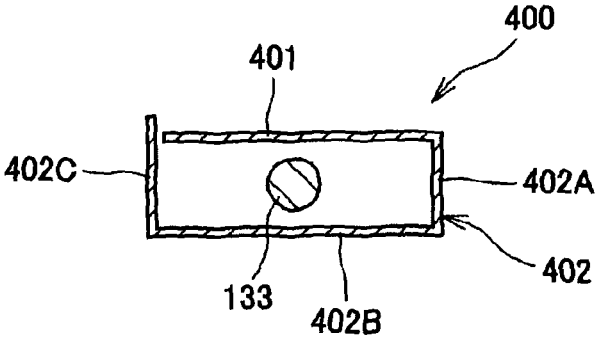
FIG. 13C is an explanatory view of a left film according to a second modification to the embodiment.

Alternatively, FIG. 13C shows a left film 400 according to a second modification to the depicted embodiment.

The left film 400 includes a covering portion 401 and an extending portion 402 extending only from a right end (in FIG. 13C) of the covering portion 401. Specifically, the extending portion 402 is bent to provide a first bent portion 402A, a second bent portion 402B and a third bent portion 402C. The first bent portion extends from the right end of the covering portion 401 downward in FIG. 13C. The second bent portion 402B extends leftward from a lower end of the first bent portion 402A. The third bent portion 402C extends upward from a left end of the second bent portion 402B. With this configuration, the pin 133 can also be covered by the left film 400.

In the left film 200 of the above-described embodiment, the left terminal 140 is sandwiched in the up-down direction between the first fixing portion 201 and second fixing portion 202. However, the left film 200 may be configured such that the left terminal 140 is sandwiched. For example, the first fixing portion 201 and second fixing portion 202 may not be connected to one another as in the embodiment. Alternatively, the second fixing portion 202 may not be provided in the left film 200.

Further, in the left film 200 of the embodiment, the first covering portion 203 and second covering portion 204 are arranged to overlap with a part of the end portion 132 of the heater 130 in the left-right direction, as shown in FIG. 7A. However, the left film 200 may alternatively be configured such that only the second covering portion 204 is arranged to overlap with the part of the end portion 132 of the heater 130.

The left film 200 is formed with the through-hole 201C in the above embodiment. However, the through-hole 201C may be dispensed with.

The left film 200 of the embodiment includes the first and second concave portions 201A and 202A. However, the concave portions (201A, 202A) may not be provided in the left film 200.

The right film 210 of the depicted embodiment includes the connection portion 213 connecting the heat shield portion 211 and fixing portion 212. However, the right film 210 need not include the fixing portion 212 and connection portion 213.

In the right film 210 of the embodiment, the heat shield portion 211 is received in the groove 166 of the frame 160. However, the heat shield portion may not necessarily be disposed in the groove 166.

The right film 210 includes the bent portions 214 in the above embodiment, but the bent portions 214 may not be provided in the right film 210.

The right film 210 covers almost the first right wall 165 (except the part facing the pin opening 215). Alternatively, the right film 210 may cover the entire first right wall 165.

The heat shield portion 211 of the right film 210 protrudes higher relative to the first right wall 165 in the above embodiment. However, the heat shield portion 211 may not protrude relative to the first right wall 165.

The heat shield portion 211 of the right film 210 has the grip portion 216 in the above embodiment. However, the grip portion 216 may be dispensed with.

The right film 210 of the above embodiment includes the extending portion 217. However, the extending portion 217 may be dispensed with.

The left and right films 200 and 210 are fixed to the frame 160 together with the left and right terminals 140 and 150 respectively in the above embodiment. Alternatively, left and right films may be fixed to a frame separately from respective left and right terminals. Still alternatively, left and right terminals may be fixed to a frame after left and right films are temporarily fixed to the frame, for example, by press fitting.

The left and right films 200 and 210 are formed of polyimide resin (for example, Kapton®) in the above embodiment. Alternatively, the left and right films 200 and 210 may be formed of a fluorine resin, a metal plate (aluminum plate, for example), an LCP (Liquid Crystal Polymer), or a ceramic plate.

The frame 160 is formed of a glass-fiber reinforced resin in the above embodiment, but the frame 160 may be made of a material other than glass-fiber reinforced resin.

In the depicted embodiment, the present invention is applied to the color printer 1. But the present invention may also be applicable to image forming apparatuses of various types, such as a copier and a multifunction device.

While the invention has been described in detail with reference to the embodiments thereof, it would be apparent to those skilled in the art that various changes and modifications may be made therein without departing from the spirit of the invention.

What is claimed is:

1. A fixing device comprising:

a tubular body defining an internal space therein, the tubular body extending in a first direction and having an open end in the first direction;

a heater disposed in the internal space and extending in the first direction, the heater comprising:

a hollow tube extending in the first direction and defining a hollow space therein;

a heat generating element disposed in the hollow space;

a terminal; and a pin connecting the heat generating element and the terminal;

a frame configured to support the tubular body, the frame having a first wall positioned closest to the open end in the first direction, the terminal being fixed to the frame; and a plate-like member provided on the frame and extending in a second direction perpendicular to the first direction, the plate-like member being positioned between the open end and the first wall in the first direction, the plate-like member being formed with a pin opening for permitting the pin to penetrate therethrough;

wherein the frame further includes a groove configured to receive the plate-like member therein;

wherein the first wall includes an opposing portion configured to oppose the pin opening in the first direction;

wherein the plate-like member is configured to cover the first wall excluding the opposing portion; and wherein the plate-like member includes a shielding portion positioned between the open end and the first wall in the first direction to cover the first wall, the shielding portion having a protruding region protruding outward relative to the first wall in the second direction.

2. The fixing device as claimed in claim 1, wherein the plate-like member includes:

a bent portion extending from the shielding portion toward the tubular body in the first direction, the bent portion being positioned within the groove.

3. The fixing device as claimed in claim 1, wherein the plate-like member further includes a grip portion protruding from the protruding region of the shielding portion in the second direction.

4. The fixing device as claimed in claim 3, wherein the plate-like member further includes:

a fixing portion configured to be fixed to the frame; and a connecting portion connecting the fixing portion and the grip portion.

5. The fixing device as claimed in claim 1, wherein the plate-like member further includes a fixing portion configured to be fixed to the frame, the fixing portion being formed with a fixation opening, and wherein the frame further includes:

an engaging portion configured to be engaged with the fixation opening; and a second wall positioned opposite to the first wall with respect to the terminal, the engaging portion and the fixation opening being engaged at an engaging position, the fixing portion having an edge positioned opposite to the tubular body with respect to the fixation opening, and wherein the engaging position and the edge define a first distance therebetween in the first direction and the engaging position and the second wall define a second distance therebetween in the first direction, the first distance being shorter than the second distance.

6. A fixing device comprising:

a tubular body defining an internal space therein;

a heater disposed in the internal space;

a terminal connected to the heater;

a frame configured to support the tubular body and having an attachment surface to which the terminal is fixed; and an insulating member provided between the terminal and the attachment surface, the insulating member including a first portion disposed between the terminal and the attachment surface and a second portion positioned opposite to the attachment surface with respect to the terminal, wherein the insulating member is configured to move from a closed state where the first portion and the second portion face each other to an open state where the first portion and the second portion are separated away from each other.

7. The fixing device as claimed in claim 6, wherein the insulating member is fixed to the attachment surface of the frame together with the terminal.

8. The fixing device as claimed in claim 6, wherein the first portion and the second portion are connected to each other at a side of the insulating member opposite to the heater with respect to the terminal.

9. The fixing device as claimed in claim 6, wherein the terminal includes:

a main portion configured to be covered by the insulating member and a protruding portion protruding from the main portion, and wherein the insulating member is formed with a through-hole configured to permit the protruding portion to penetrate therethrough.

10. The fixing device as claimed in claim 9, wherein the frame includes an opening, and wherein the terminal further includes a terminal extending portion extending from the main portion and protruding outward relative to the insulating member to be received in the opening of the frame.

11. The fixing device as claimed in claim 6, wherein the terminal further includes a terminal recess, wherein the insulating member includes a concave portion formed at a position coincident with the terminal recess, and wherein the frame includes an engagement portion protruding from the attachment surface and configured to engage the terminal recess and the concave portion.

12. A fixing device comprising:

a tubular body extending in a first direction and defining an internal space therein;

a heater disposed in the internal space and extending in the first direction, the heater comprising:

a hollow tube extending in the first direction and defining a hollow space therein, the tube having one end portion in the first direction;

a heat generating element disposed in the hollow space;

a terminal; and a pin provided at the one end portion of the tube and connecting the heat generating element and the terminal;

a frame configured to support the tubular body, the terminal being fixed to the frame; and an insulating member having a fixing portion fixed to the frame and a covering portion extending from the fixing portion toward the pin to cover the pin, the covering portion further extending to overlap with the one end portion of the tube in the first direction to cover an entirety of the pin in the first direction, wherein the fixing portion includes:

a first fixing portion disposed between the terminal and the frame, and a second fixing portion positioned opposite to the first fixing portion with respect to the terminal; and wherein the covering portion includes a first covering portion extending from the first fixing portion and a second covering portion extending from the second fixing portion, the pin being positioned between the first covering portion and the second covering portion; and wherein the second covering portion has a portion overlapping with the one end portion of the tube in the first direction.

13. The fixing device as claimed in claim 12, wherein one of the first covering portion and the second covering portion includes a pair of extending portions extending toward remaining one of the first covering portion and the second covering portion, the pin being positioned between the pair of extending portions.

14. The fixing device as claimed in claim 13, wherein the pair of extending portions extend from the first covering portion.

15. The fixing device as claimed in claim 12, wherein the first fixing portion and the second fixing portion are connected to each other at a side opposite to the pin with respect to the terminal in the first direction.

* * * * *